US009328460B2

(12) United States Patent
Scherb et al.

(10) Patent No.: US 9,328,460 B2
(45) Date of Patent: May 3, 2016

(54) METHOD AND DEVICE FOR DRYING A FIBROUS WEB

(75) Inventors: Thomas Scherb, Sao Paulo (BR); Joao V. Boechat, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 1135 days.

(21) Appl. No.: 13/206,802

(22) Filed: Aug. 10, 2011

(65) Prior Publication Data

US 2012/0000089 A1 Jan. 5, 2012

Related U.S. Application Data

(63) Continuation of application No. PCT/EP2010/050895, filed on Jan. 27, 2010.

(30) Foreign Application Priority Data

Feb. 11, 2009 (DE) ..... 10 2009 000 753

(51) Int. Cl.

| | |
|---|---|
| ***F26B 3/00*** | (2006.01) |
| ***D21F 5/20*** | (2006.01) |
| ***D21F 3/02*** | (2006.01) |
| ***D21F 5/18*** | (2006.01) |

(52) U.S. Cl.

CPC ..... *D21F 5/20* (2013.01); *D21F 3/0272* (2013.01); *D21F 5/181* (2013.01)

(58) Field of Classification Search

CPC ..... D21F 3/0272; D21F 5/20; D21F 5/181; D21F 5/028; D21F 5/044; D21F 5/02

USPC ..... 34/444, 514, 618, 86, 422

See application file for complete search history.

(56) References Cited

U.S. PATENT DOCUMENTS

| | | | |
|---|---|---|---|
| 7,351,307 | B2 | 4/2008 | Scherb et al. |
| 2005/0160618 | A1 | 7/2005 | Viljanmaa |

(Continued)

FOREIGN PATENT DOCUMENTS

| | | | |
|---|---|---|---|
| EP | 1079189 | A1 | 2/2001 |
| EP | 1959053 | A1 | 8/2008 |

(Continued)

OTHER PUBLICATIONS

International Search Report for PCT/EP2010/050895, dated Apr. 29, 2010. (6 pages).

*Primary Examiner* — Kenneth Rinehart
*Assistant Examiner* — Bao D Nguyen
(74) *Attorney, Agent, or Firm* — Taylor IP, P.C.

(57) ABSTRACT

The invention relates to a method and to a device for drying a fibrous web wherein the traveling fibrous web is acted upon by steam and hot, moist air in the region of a preceding drying zone and is then fed to the preceding drying zone of a downstream drying zone comprising a drying cylinder and a hood allocated thereto. Hot air is taken out of the hood allocated to the drying cylinder of the downstream drying zone. To create at least a portion of the steam for the preceding drying zone, condensate and/or fresh water occurring in the drying cylinder of the downstream drying zone is heated by the hot air taken out of the hood by means of a first heat exchanger. Alternatively or additionally for creating at least a portion of the hot, moist air for the preceding drying zone, the hot air taken out of the hood guided through the first heat exchanger is fed to the preceding drying zone.

26 Claims, 5 Drawing Sheets

(56) References Cited

U.S. PATENT DOCUMENTS

| | | | | |
|---|---|---|---|---|
| 2007/0256806 | A1* | 11/2007 | Scherb et al. | 162/358.4 |
| 2008/0189981 | A1* | 8/2008 | Munch | 34/618 |
| 2009/0188128 | A1* | 7/2009 | Gissing et al. | 34/514 |

FOREIGN PATENT DOCUMENTS

| | | | |
|---|---|---|---|
| GB | 2155164 | A | 9/1985 |
| WO | 2008077874 | A1 | 6/2008 |
| WO | 2009117751 | A1 | 10/2009 |

* cited by examiner

METHOD AND DEVICE FOR DRYING A FIBROUS WEB

CROSS REFERENCE TO RELATED APPLICATIONS

This is a continuation of PCT application No. PCT/EP2010/050895, entitled "METHOD AND DEVICE FOR DRYING A FIBROUS WEB", filed Jan. 27, 2010, which is incorporated herein by reference.

BACKGROUND OF THE INVENTION

1. Field of the Invention

The present invention relates to a machine and a method for drying a fibrous web, in particular a cardboard, paper or tissue web, wherein the traveling fibrous web is acted upon by steam and hot, moist air in the region of a preceding drying zone and, following the preceding drying zone, is fed to a downstream drying zone which includes a drying cylinder, for example a Yankee cylinder, as well as a hood allocated thereto.

2. Description of the Related Art

U.S. Pat. No. 7,351,307 B2 and WO 2008/077874 describe a method for the production of a voluminous tissue web wherein a so-called belt press is used in conjunction with a hot air hood and the use of steam for dewatering the fibrous web to a certain dry content. It is particularly important for tissue machines of this type to reduce energy consumption, especially during the drying process to achieve a predetermined dry content. Moreover there is a requirement to increase the dry content with minimal energy expenditure.

A method is known, for example from EP 1 959 053, wherein exhaust air from the hood allocated to a Yankee cylinder is supplied to the hot air hood of a belt press. A large amount of steam is used by the dryer units which include a Yankee cylinder with allocated dryer hood or respectively a belt press. The energy costs associated with this result in accordingly higher costs in the paper production. Previously, the exhaust air of a hood allocated to the Yankee cylinder containing a high energy content was used to preheat the hood combustion air for the Yankee dryer and water used in the paper machine.

The technology based on the use of a belt press involves an even higher steam consumption compared to conventional tissue machines which overall, leads to a negative energy balance. For this technology which is based on a belt press, hot, moist air is required as an additional energy, for which previously exhaust air from the hood allocated to the Yankee cylinder was used. To this end it was previously necessary to mix the exhaust air from the Yankee hood with fresh air in order to reduce the temperature of the air supplied to the belt press to the value necessary in this belt press. Accordingly, the moisture and enthalpy of the hot air were reduced. The temperature of the Yankee hood exhaust air is regularly higher than the temperature at which the belt press can operate.

What is needed in the art is an improved method, as well as an improved device or machine, wherein the drying process, especially in regard to the energy requirement for dewatering of the fibrous web, is further optimized. To this end, the drying process, for example in the case of combined drying in a belt press and a subsequent drying unit including a Yankee cylinder with allocated dryer hood is to be accordingly optimized.

SUMMARY OF THE INVENTION

The present invention provides a heat recovery system and method of drying a fibrous web wherein hot air, for example exhaust air, is taken from the hood allocated to the drying cylinder of the downstream drying zone and, to produce at least a portion of the steam for the preceding drying zone, condensate and/or fresh water occurring in the drying cylinder of the downstream drying zone is heated by the hot air extracted from the hood by means of a first heat exchanger, and/or in order to produce at least a portion of the hot, moist air for the preceding drying zone, the hot air extracted from the hood and directed through the first heat exchanger is fed to the preceding drying zone.

Based on this layout the consumed steam from the steam generator is substantially reduced, thus reducing the total energy consumption accordingly. Hereby, particularly the heat to produce steam which is then further used in the paper production process is recovered. The energy is used which becomes available due to the enthalpy-drop of the exhaust air from the hood allocated to the drying cylinder, or respectively the Yankee cylinder. On the one hand, steam is produced. On the other hand, the hot air emerging from the heat exchanger and having a lower temperature is further utilized in the paper production process, whereby the produced steam, as well as the hot air which has cooled to a lower temperature, can be further utilized, for example in a belt press.

In accordance with a first embodiment of the method of the present invention, steam is immediately produced from the furnished condensate and/or fresh water by means of the first heat exchanger and this steam is fed to the preceding drying zone.

According to a second embodiment of the method of the present invention, the condensate and/or fresh water is first heated by means of the first heat exchanger. Following this first heat exchanger, the heated condensate and/or fresh water are then fed to a flash-evaporation device whereby the steam produced through flash evaporation is then fed to the preceding drying zone. Condensate occurring during flash evaporation is advantageously returned to the first heat exchanger and is heated in same by the hot air extracted from the hood, together with the condensate and/or fresh water occurring in the drying cylinder of the downstream drying zone.

According to a third embodiment of the inventive method, fresh air is heated in a second heat exchanger by means of hot air taken from the hood, and the thereby heated fresh air is supplied as combustion air and/or make-up air to the hood allocated to the drying cylinder of the downstream drying zone. "Make-up" air is to be understood, for example, to be air for preheating of the drying zone and/or the drying system. Preheating occurs, for example, during start-up of the tissue machine.

The extracted hot air can be directed first through the first heat exchanger which is provided for heating of the condensate and/or the fresh water and subsequently through the second heat exchanger which is provided for heating of the fresh air before it is furnished to the preceding drying zone.

According to a fourth embodiment of the method of the present invention, it is also possible to direct the hot air taken from the hood first through the second heat exchanger which is provided to heat the fresh air, and subsequently through the first heat exchanger which is provided for heating the condensate and/or fresh water, before it is furnished to the preceding drying zone.

The inventive machine for the production of a fibrous web, especially a cardboard, paper or tissue web is configured such that, for the production of at least a portion of the steam for the preceding drying zone, a first heat exchanger is provided which is furnished with hot air, for example exhaust air from the hood allocated to the drying cylinder of the downstream drying zone, in order to heat condensate and/or fresh water occurring in the drying cylinder of the downstream drying zone by means of this hot air taken from the hood; and/or in order to produce at least a portion of the hot, moist air for the preceding dying zone, the hot air taken from the hood and directed through the first heat exchanger is fed to the preceding drying zone.

According to a first embodiment of the inventive machine, the preceding drying zone includes a suction-equipped device, for example a suction roll over which the fibrous web is guided, together with a least one permeable belt, such as a structured fabric or through air drying (TAD) fabric, whereby steam or respectively hot, moist air flows first through the permeable belt and subsequently through the fibrous web.

The fibrous web may be covered by at least one additional permeable belt, for example a press belt, whereby steam or respectively hot, moist air first flows through the additional permeable belt or respectively press belt, then through the first permeable belt or respectively structured fabric and subsequently through the fibrous web. When using a press belt, a type of belt press is created whereby, in addition to the mechanical pressure, in particular combined hot air and steam drying is applied.

In addition, a dewatering belt, for example a felt belt, can be directed over the suction equipped device or respectively the suction roll, together with the fibrous web, whereby steam or respectively hot, moist air first flows through the additional permeable belt or respectively the press belt, if present, then through the first permeable belt, or respectively the structured fabric, and the fibrous web and finally through the additional dewatering belt.

Steam, produced from the furnished condensate and/or fresh water can be provided directly to the preceding drying zone by means of the first heat exchanger. As already mentioned it is, however, also conceivable to initially merely heat the condensate and/or fresh water by means of the first heat exchanger and to furnish the condensate and/or fresh water so heated by this first heat exchanger to a flash-evaporation device. In this case the steam produced through flash evaporation is fed to the preceding drying zone.

The appropriate evaporation system may also include one or several pumps for circulation of the water. With these pumps in particular, a higher pressure of the water circulating within the first heat exchanger can be achieved, whereby this pressure can be in a range of approximately 3 to approximately 20 bar. The water absorbs heat from the air which was directed through the heat exchanger and its surface tension is then lowered.

In the hereby occurring flash evaporation the water pressure is reduced, thus producing steam. The water with the higher pressure evaporates at a higher temperature. If the water is maintained at a higher pressure then its temperature may be raised without evaporation. If the pressure is then reduced to a value which possesses a boiling temperature below the previous temperature the flash process begins automatically.

The generated steam can be precipitated in a suitable chamber and can be used for the subsequent drying process, for example in tissue production.

A second heat exchanger may be provided in order to heat the fresh air with the hot air taken from the hood, whereby the thus heated fresh air is furnished as combustion air and/or make-up air to the hood allocated to the drying cylinder of the downstream drying zone. As already mentioned, "make-up air" is to be understood to be air, for example, for pre-heating of the drying zone and/or the drying system. Pre-heating is done, for example, during start-up of the tissue machine.

The current invention provides advantages, especially in regard to steam consumption, for example when using a Yankee-dryer and/or a belt press. The generated volume of steam depends on conditions such as air mass flow, air temperature and moisture, on whether or not an air/air-heat exchanger is provided, etc.

At least one heat exchanger with, for example, a flow-regulated bypass, may be provided for the hot air which is taken from the hood.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
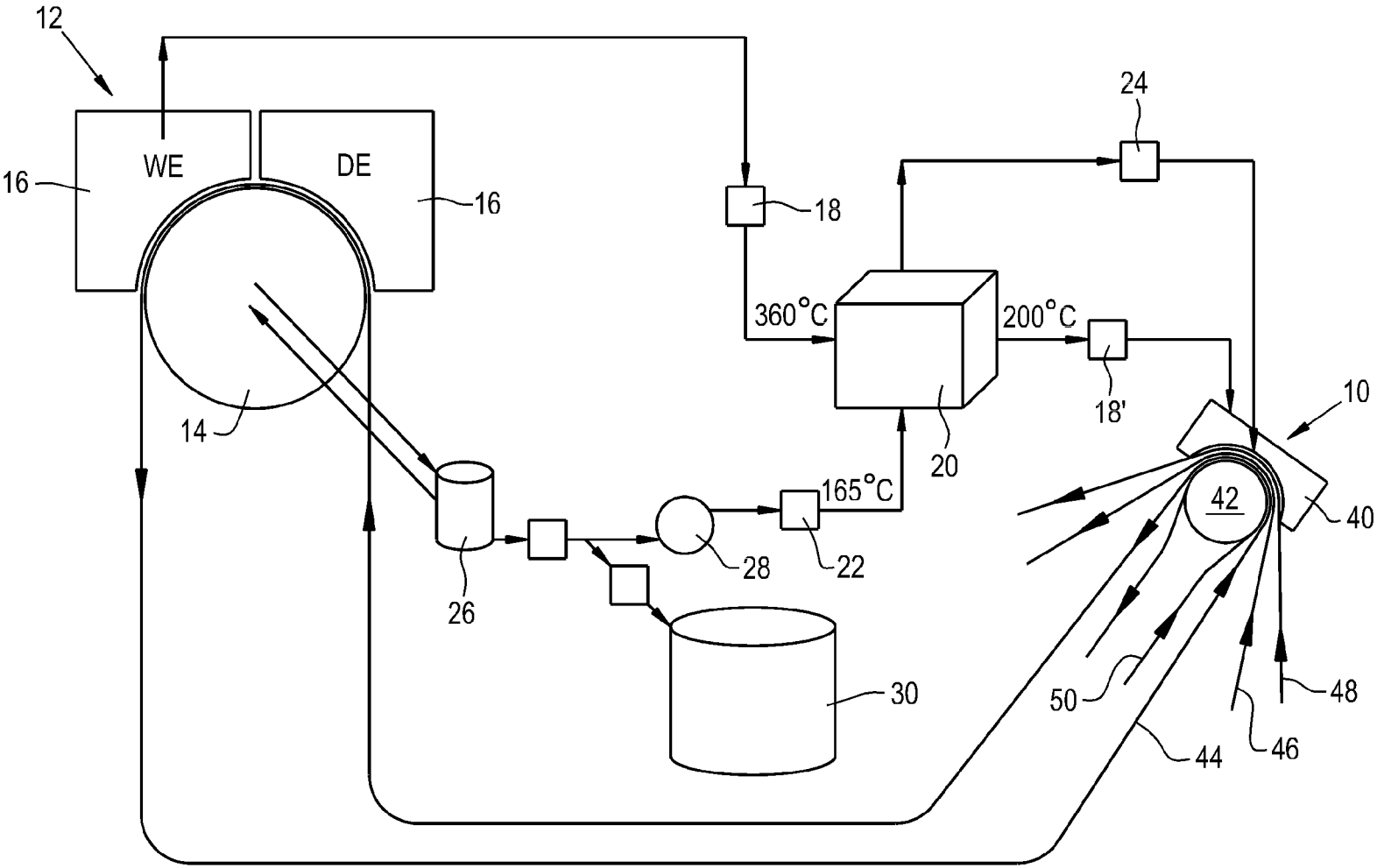
FIG. 1 is a schematic flow diagram of a first embodiment of the inventive heat recovery system.

Referring now to the drawings, and more particularly to FIG. 1, there is shown a schematic flow diagram of a first embodiment of the inventive heat recovery system of a machine for the production of a fibrous web 44, in particular a cardboard, paper or tissue web. The moving fibrous web 44 is acted upon by steam, as well as hot, moist air in the region of preceding drying zone 10. Subsequently, the fibrous web 44 is fed into downstream drying zone 12. Preceding drying zone 10 may hereby include, for example, suction-equipped device 42, such as a suction roll over which the fibrous web 44 is guided, together with a least one permeable belt 46, in particular a structured fabric or TAD-fabric, whereby steam or respectively hot, moist air flow first through the permeable belt 46 and then through the fibrous web 44.

The fibrous web 44 can moreover be covered by at least one additional permeable belt 48, for example a press belt, whereby in this case steam or respectively hot, moist air first flow through the additional permeable belt 48 or respectively press belt, then through the first permeable belt 46, or respectively structured fabric, and subsequently through the fibrous web 44. When using a press belt 48 a type of belt press is created whereby, in addition to the mechanical pressure, in particular combined hot air and steam drying is applied.

In addition, a dewatering belt 50, for example a felt belt, can be directed over suction equipped device 42 or respectively the suction roll, together with the fibrous web 44, whereby steam or respectively hot, moist air first flow through the additional permeable belt 48 or respectively the press belt, if present, then through the first permeable belt 46 or respectively the structured fabric and the fibrous web 44 and subsequently through the additional dewatering belt 50.

Downstream drying zone 12 may include drying cylinder 14, for example a Yankee-cylinder, as well as hood 16 allocated to same which can be a hot air hood.

Hot air 18, for example exhaust air, is taken from hood 16 allocated to drying cylinder 14. To generate at least a portion of the steam for preceding drying zone 10, condensate and/or fresh water occurring in drying cylinder 14 of downstream drying zone 12 is heated by hot air 18 taken from hood 16 by means of first heat exchanger 20.

To produce at least a portion of the hot, moist air for preceding drying zone 10, hot air 18 taken from hood 16 and directed though first heat exchanger 20 is furnished to preceding drying zone 10. Since hot air 18 gives off heat to condensate 22 or respectively to fresh water, their temperature is lowered, so that moist hot air 18' eventually furnished to preceding drying zone 10 possesses a temperature suitable for the special drying process in drying zone 10. Hot air 18 furnished to heat exchanger 20 can, for example, have a temperature in the range of approximately 360° C. and moist hot air 18' eventually furnished to preceding drying zone 10 can have a temperature in the range of approximately 200° C. Condensate 22 supplied to heat exchanger 20 can, for example, have a temperature in the range of for example 165° C.

In the present example, steam 24 is produced immediately from supplied condensate 22 and/or fresh water by means of first heat exchanger 20 and is then furnished to preceding drying zone 10.

As can be seen in FIG. 1, steam separator 26 can moreover be provided which is located between cylinder 14 and pump 28, through which condensate 22 is supplied to heat exchanger 20. In addition, steam generator 30 is also shown in this FIG. 1. Heat exchanger 20 is an air/water heat exchanger.

Figure 2:
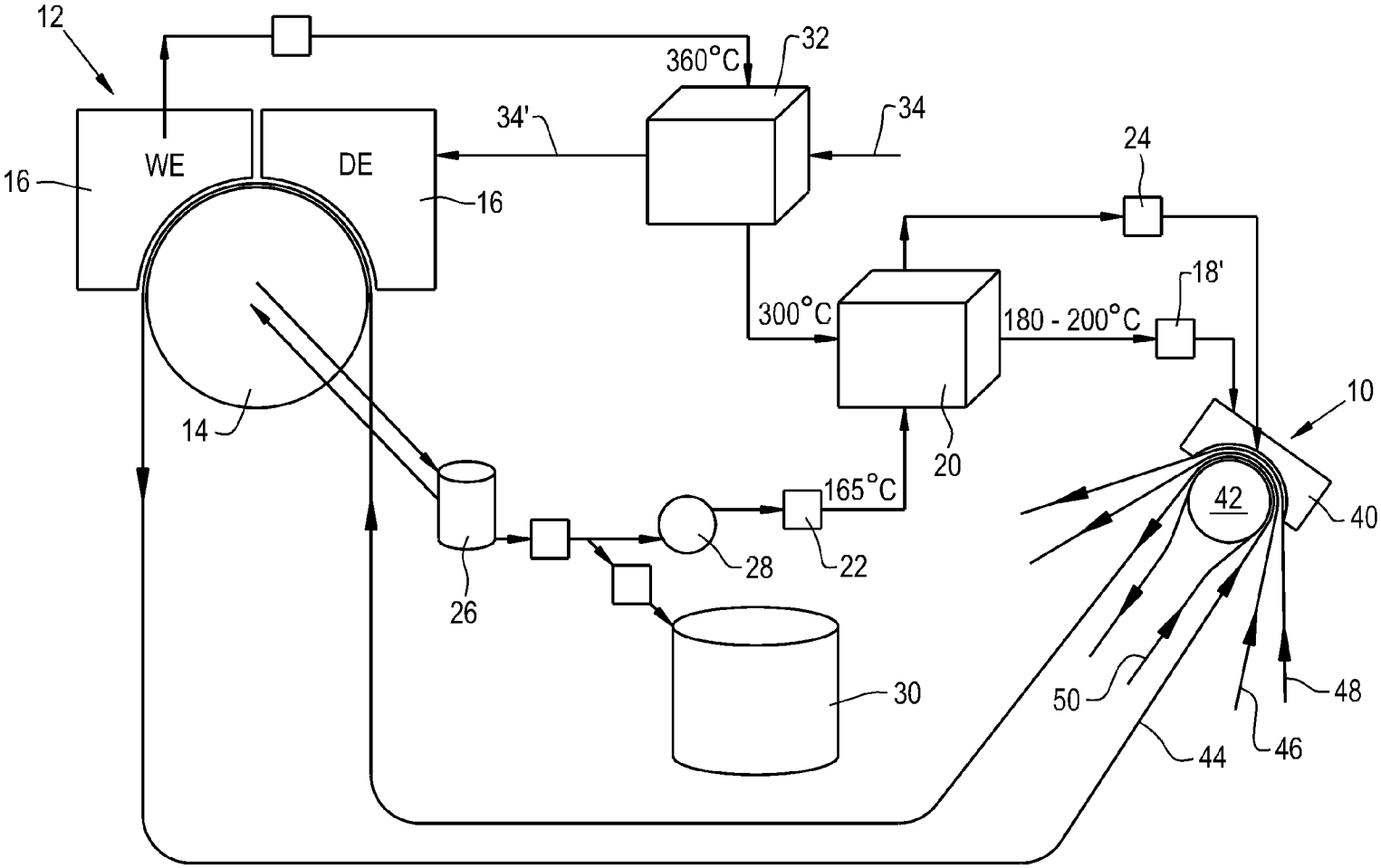
FIG. 2 is a schematic flow diagram of a second embodiment of the heat recovery system of the present invention.

Referring now to FIG. 2, there is shown a schematic flow diagram of a second embodiment of the heat recovery system of the present invention which differs from the embodiment illustrated in FIG. 1 essentially in that fresh air 34 is heated by hot air 18 taken from hood 16 by means of second heat exchanger 32 and the thus heated fresh air 34' is furnished as combustion air to hood 16 which is allocated to drying cylinder 14 of downstream drying zone 12. Second heat exchanger 32 therefore is an air/air-heat exchanger.

In the present example, hot air 18 taken from hood 16 is first directed through second heat exchanger 32, which is provided for heating fresh air 34, and then through the first heat exchanger 20, which is provided for heating condensate 22 and fresh air, before it is furnished to preceding drying zone 10.

In principle however, an embodiment is, for example, also possible where extracted hot air 18 is first directed through first heat exchanger 20, which is provided for heating condensate 22 and/or fresh water, and then through second heat exchange 32 which is provided for heating fresh air 34, before it is furnished to preceding drying zone 10.

Figure 3:
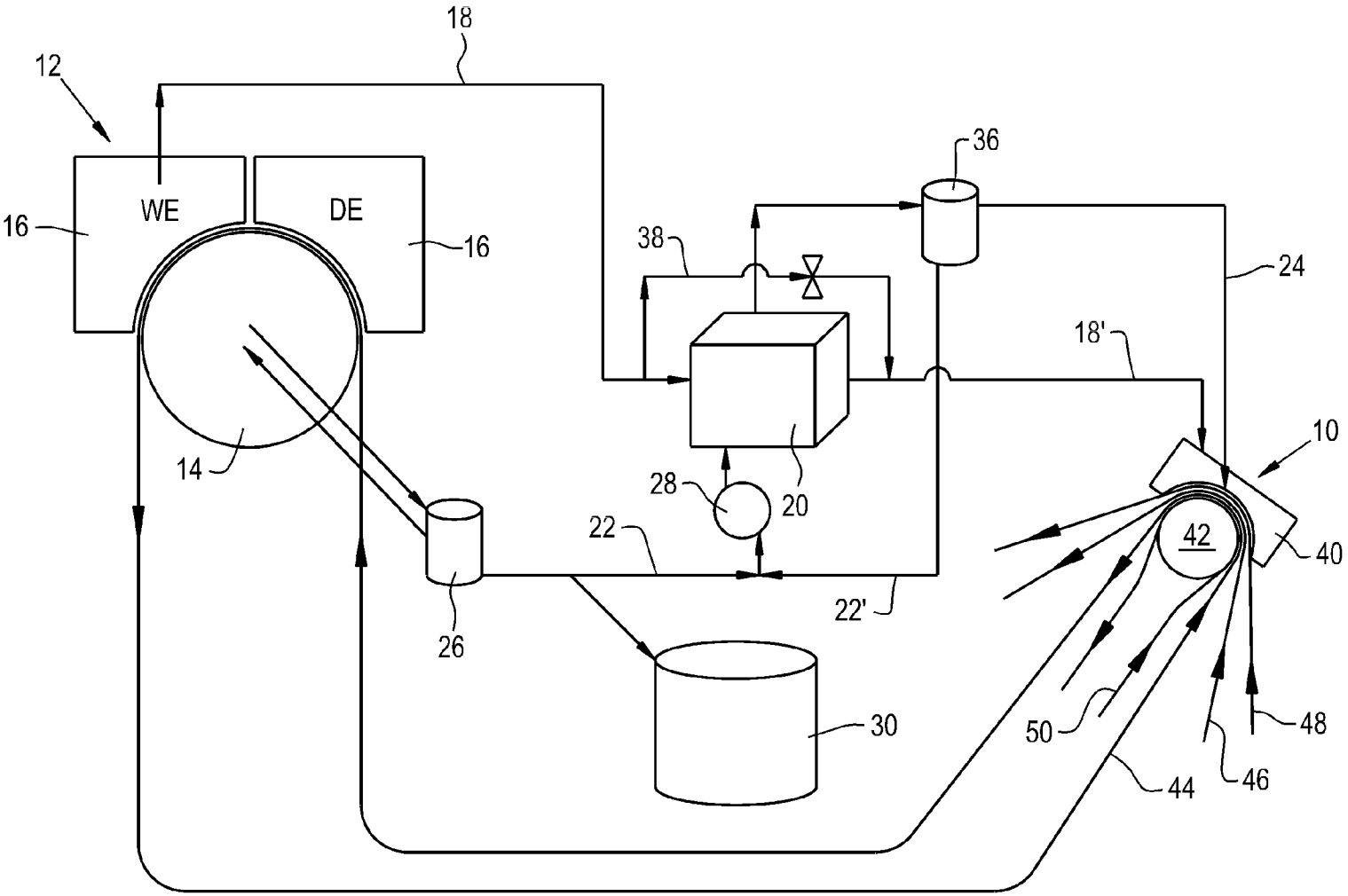
FIG. 3 is a schematic flow diagram of a third embodiment of the heat recovery system according to the present invention.

Referring now to FIG. 3, there is shown a schematic flow diagram of a third embodiment of the heat recovery system of the present invention which differs from the embodiment illustrated in FIG. 1 essentially in that condensate 22 and/or fresh water is heated by first heat exchanger 20 under increased pressure which, for example, is in the range of approximately 3 bar to approximately 20 bar and in that condensate 22 and/or fresh water which is heated by means of first heat exchanger 20 and which is under increased pressure is then furnished to a flash evaporation device. In this case therefore, steam 24 which is generated through flash evaporation (flashing) and which, compared to furnished heated condensate 22, or respectively fresh water, has a lower pressure is furnished to preceding drying zone 10.

Heat exchanger 20 can be provided with flow controlled bypass 38 for hot air 18 taken from hood 16. This provides greater flexibility in regard to the volume of steam produced for preceding drying zone 10, preheating of the combustion air (compare for example FIG. 4) or even an increase in temperature in dryer- or hot air hood 40 allocated to preceding drying zone 10.

As can be seen in FIG. 3, condensate 22', occurring during flashing, can be returned to first heat exchanger 20 and can be heated in same together with condensate 22 and/fresh water occurring in drying cylinder 14 of downstream drying zone 12 by hot air 18 taken from hood 16.

Figure 4:
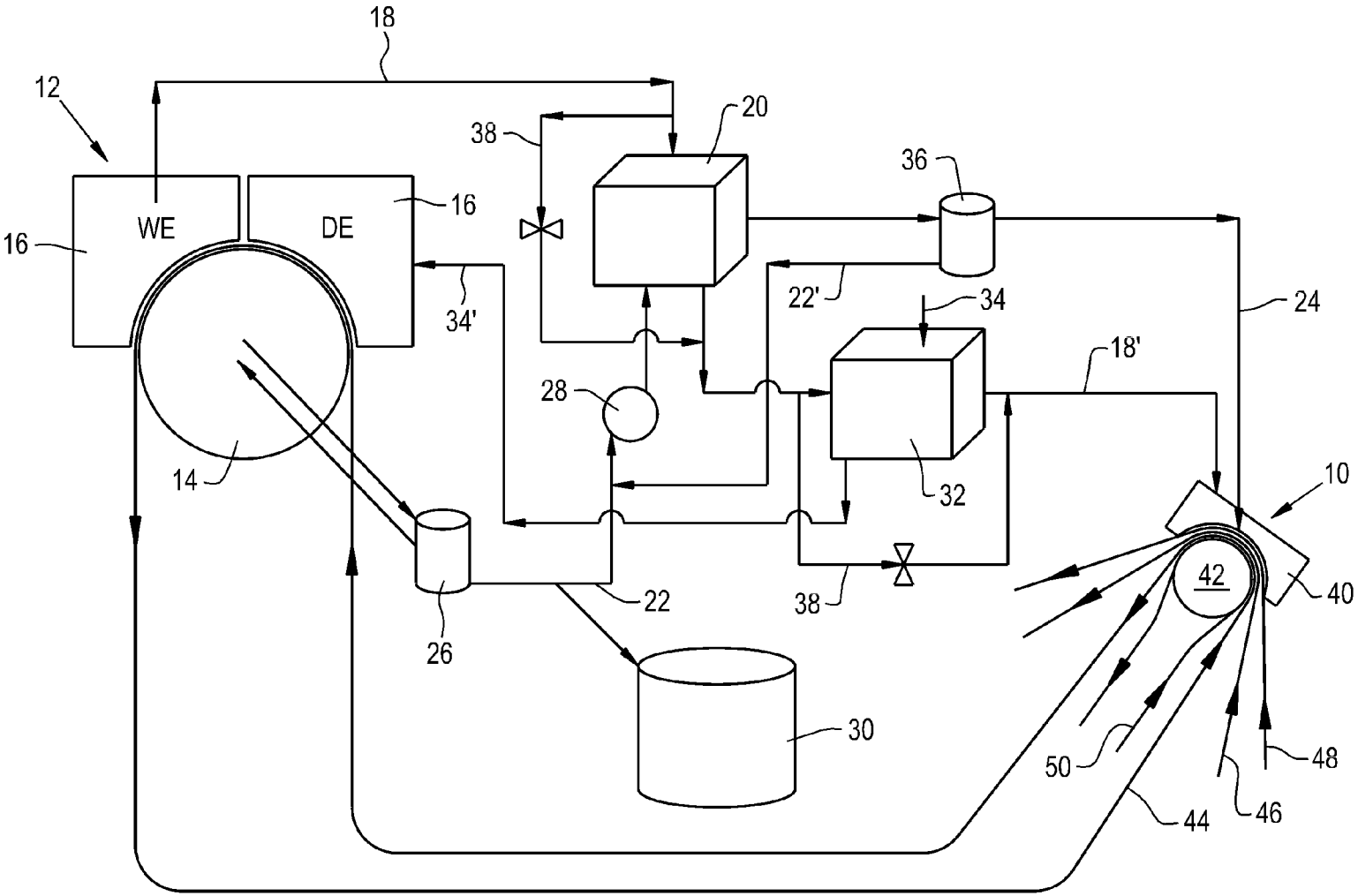
FIG. 4 is a schematic flow diagram of a fourth embodiment of the heat recovery system of the present invention including a flash evaporation device.

Referring now to FIG. 4, there is shown a schematic flow diagram of a fourth embodiment of the heat recovery system of the present invention which differs from the embodiment illustrated in FIG. 3 essentially in that fresh air 34 is heated in addition by means of second heat exchanger 32 by hot air 18 taken from hood 16 and the thus heated fresh air 34' is furnished as combustion air to hood 16 allocated to drying cylinder 14 of downstream drying zone 12. In the current example, extracted hot air 18 is first directed through first heat exchanger 20, which is provided for heating of condensate 22 and/or fresh water, and then through second heat exchanger 32, which is provided for heating fresh air 34, before it is furnished to preceding drying zone 10. Second heat exchanger 32 which is an air/air-heat exchanger can also be equipped with flow regulated bypass 38 for hot air 18 taken from hood 16.

Figure 5:
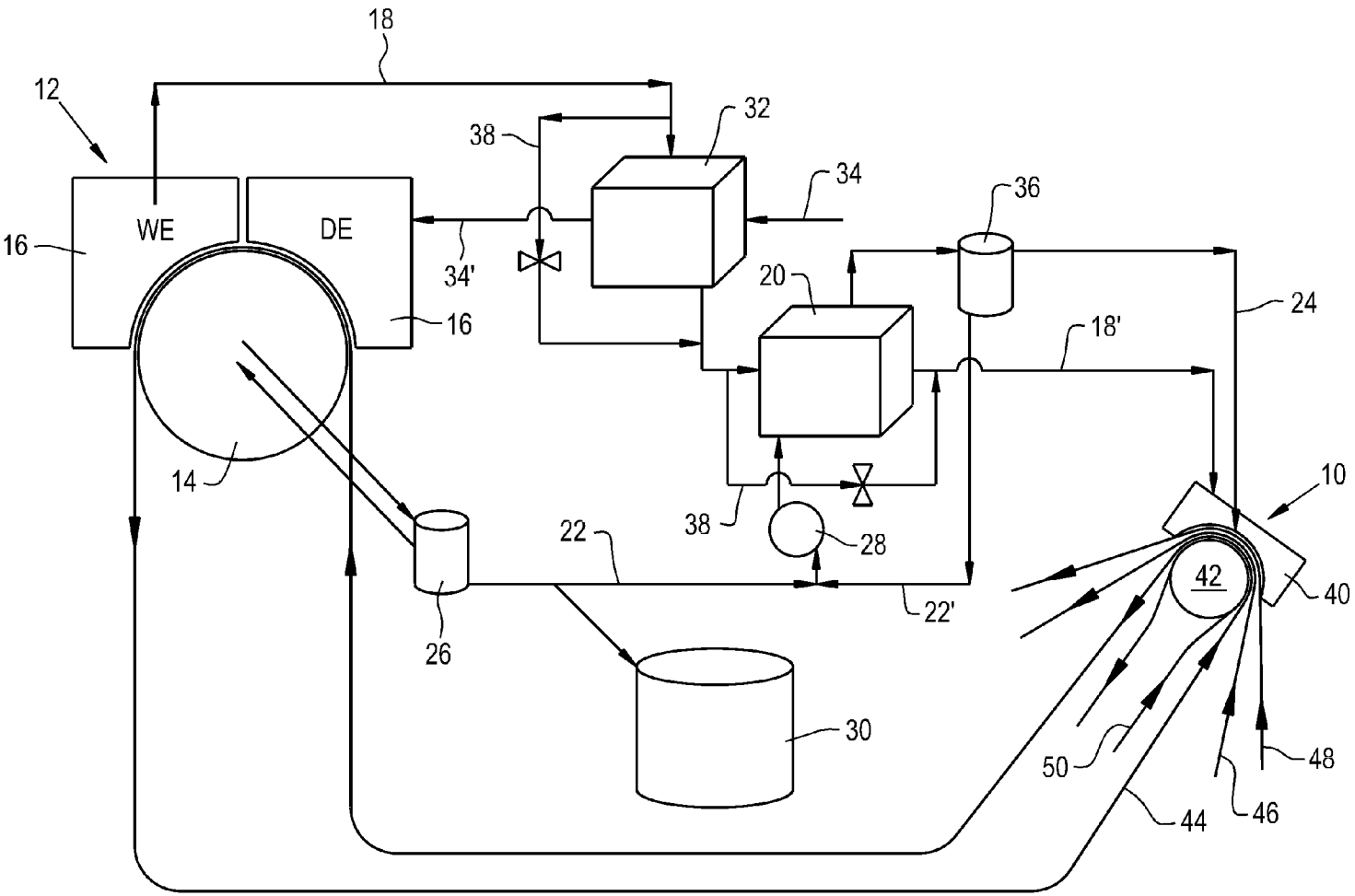
FIG. 5 is a schematic flow diagram of a fifth embodiment of the heat recovery system of the present invention including a flash evaporation device.

Referring now to FIG. 5, there is shown a schematic flow diagram of a fifth embodiment of the heat recovery system of the present invention which differs from the design form illustrated in FIG. 4 essentially in that hot air 18 taken from hood 16 is first directed through second heat exchanger 32, which is provided for heating fresh air 34, and then through first heat exchanger 20, which is provided for heating condensate 22 and/or fresh water, before it is furnished to preceding drying zone 10.

A concrete example is given in the following chart which reproduces the potential for steam generation according to the energy content in the exhaust hair of the hood or dryer hood 16 allocated to cylinder 14 of downstream drying zone 12. The produced steam can be utilized at least partially in a steam blow box allocated to preceding drying zone 10 or even in the Yankee cylinder. This assumes, for example, a heat recovery system as shown in FIG. 3 where only first heat exchanger 20 is provided for heat recovery.

The following was assumed for this example:

Temperature of exhaust air of Yankee-hood: 360° C.

Moisture of exhaust air of Yankee-hood: 450 grams (g)/kilogram (kg) air

Temperature of exhaust air of Yankee-hood after heat recovery (WR): 250° C.

Yankee-hood exhaust air flow: 6.45 kg/second (s) (dry mass)

Condensate pressure: 15 bar

Condensate temperature before heat recovery: 110° C.

Condensate temperature after heat recovery: 183° C.

Pressure of steam produced through flashing: 3 bar.

| Yankee-hood exhaust air-before WR (heat recovery) | | |
|---|---|---|
| Temperature | [° C.] | 360 |
| Moisture | [g/kg] | 450 |
| Enthalpy | [kJ/kg] | 2080 |
| Dry air flow | [kg/s] | 6.45 |
| Total air flow | [kg/s] | 9.35 |

Heat recovery (WR)

| Yankee-hood exhaust air-after WR (heat recovery) | | |
|---|---|---|
| Temperature | [° C.] | 250 |
| Moisture | [g/kg] | 450 |
| Enthalpy | [kJ/kg] | 1867 |
| Dry air flow | [kg/s] | 6.45 |
| Total air flow | [kg/s] | 9.35 |

to belt press hood

| Condensate-before WR | | |
|---|---|---|
| Temperature | [° C.] | 110 |
| Pressure | [bar] | 15 |
| Enthalpy | [kJ/kg] | 462 |
| Flow | [kg/h] | 15600 |
| Flow | [kg/s] | 4.33 |

| Condensate-after WR | | |
|---|---|---|
| Temperature | [° C.] | 183 |
| Pressure | [bar] | 15 |
| Enthalpy | [kJ/kg] | 778 |
| Condensate flow | [kg/h] | 15600 |
| Condensate flow | [kg/s] | 4.33 |

Flashing

| Steam produced through flashing | | |
|---|---|---|
| Final pressure | bar | 3 |
| Liquid final temperature | [° C.] | 118 |
| Liquid End-enthalpy | [kJ/kg] | 497 |
| Evaporation-Enthalpy | [kJ/kg] | 2168 |
| Flash factor | % | 12.9% |
| Produced steam | [kg/h] | 2020 |
| Produced steam | [kg/s] | 0.56 |

| | | |
|---|---|---|
| Enthalpy of saturated steam | kJ/kg | 2705 |
| Recovered energy | kW | 1517 |

The steam production potential in this example is 2020 kg/hour (H) of steam at a pressure of 3 bar.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION

10 preceding drying zone
12 downstream drying zone
14 drying cylinder
16 hood, dryer hood
18 hot air
18' hot air
20 first heat exchanger
22 condensate
22' condensate
24 steam
26 steam separator
28 pump
30 steam generator
32 second heat exchanger
34 fresh air
34' fresh air
36 flash evaporation device
38 bypass
40 hood, dryer hood
42 suction equipped device, suction roll
44 fibrous web
46 permeable belt
48 press belt
50 dewatering belt

What is claimed is:

1. A method for drying a fibrous web, the method comprising the steps of:

acting upon the fibrous web traveling in a machine direction by steam and a hot, moist air in a region of a preceding drying zone;

feeding the traveling fibrous web to a downstream drying zone following said preceding drying zone, said downstream drying zone including a drying cylinder and a hood allocated to said drying cylinder; and heating at least one of condensate and fresh water occurring in said drying cylinder with hot air extracted from said hood through a first heat exchanger to produce at least a portion of said steam for said preceding drying zone and directing said hot air taken from said hood through said first heat exchanger and feeding said hot air to said preceding drying zone to produce at least a portion of said hot, moist air in said region of said preceding drying zone.

2. The method according to claim 1, wherein the fibrous web is one of a cardboard web, a paper web and a tissue web.

3. The method according to claim 1, wherein said drying cylinder is a Yankee cylinder.

4. The method according to claim 1, wherein said hot air taken from said hood is exhaust air.

5. The method according to claim 1, wherein said steam is produced from at least one of said condensate and fresh water by said first heat exchanger and said steam is fed to said preceding drying zone.

6. The method according to claim 1, wherein at least one of said condensate and said fresh water heated by said first heat exchanger is fed to a flash-evaporation device following said first heat exchanger to produce steam, said steam produced through said flash evaporation being fed to said preceding drying zone.

7. The method according to claim 6, wherein additional condensate occurring during said flash evaporation is returned to said first heat exchanger and is heated in said first heat exchanger by said hot air extracted from said hood together with said at least one of said condensate and said fresh water occurring in said drying cylinder of said downstream drying zone.

8. The method according to claim 7, wherein fresh air is heated in a second heat exchanger by said hot air taken from said hood and said heated fresh air is supplied as at least one of combustion air and make-up air to said hood allocated to said drying cylinder of said downstream drying zone.

9. The method according to claim 8, wherein said hot air extracted from said hood is directed first through said first heat exchanger to heat said at least one of condensate and said fresh water and subsequently through said second heat exchanger to heat said fresh air before furnishing said hot fresh air to said preceding drying zone.

10. The method according to claim 8, wherein said hot air extracted from said hood is directed first through said second heat exchanger for heating said fresh air and then through said first heat exchanger for heating said at least one of said condensate and said fresh water before said hot air is furnished to said preceding drying zone.

11. A machine for the production of a fibrous web, the machine comprising:

a preceding drying zone in which the fibrous web is moving in a machine direction and which is acted upon with a steam and a hot, moist air;

an additional drying zone located downstream from said preceding drying zone, said additional drying zone including a drying cylinder and a hood allocated to said drying cylinder; and a first heat exchanger, said hot air from said hood allocated to said drying cylinder being fed to said first heat exchanger to heat at least one of condensate and fresh water occurring in said drying cylinder of said downstream drying zone to produce at least a portion of said steam for said preceding drying zone and directed through said first heat exchanger to produce at least a portion of said hot, moist air to be furnished for said preceding drying zone.

12. The machine according to claim 11, wherein the fibrous web is one of a cardboard web, a paper web and a tissue web.

13. The machine according to claim 11, wherein said drying cylinder is a Yankee cylinder.

14. The machine according to claim 11, wherein said hot air from said hood is exhaust air from said hood.

15. The machine according to claim 11, the preceding drying zone further comprising a suction-equipped device over which the fibrous web is guided together with at least one permeable belt arranged such that said steam or said hot, moist air flows first through said permeable belt and subsequently through the fibrous web.

16. The machine according to claim 15, wherein said suction-equipped device is a suction roll.

17. The machine according to claim 15, wherein said at least one permeable belt is one of a structured fabric and a through air dryer (TAD) fabric.

18. The machine according to claim 17, wherein said at least one permeable belt includes a first permeable belt and at least one additional permeable belt, the fibrous web being covered by said at least one additional permeable belt and arranged such that said steam or said hot, moist air first flows through said additional permeable belt and then through said first permeable belt and then through the fibrous web.

19. The machine according to claim 18, wherein said at least one additional permeable belt is a press belt.

20. The machine according to claim 19, further comprising a dewatering belt directed over said suction equipped device together with the fibrous web and arranged such that said steam or said hot, moist air first flows through said additional permeable belt, then secondly flows through said first permeable belt and thirdly flows through the fibrous web and subsequently flows through said dewatering belt.

21. The machine according to claim 20, wherein said dewatering belt is a felt belt.

22. The machine according to claim 21, wherein said first heat exchanger is arranged to feed said steam produced from said at least one of said condensate and said fresh water by said first heat exchanger to said preceding drying zone.

23. The machine according to claim 20, further comprising a flash evaporation device which is configured to receive at least one of said condensate which has been heated by said first heat exchanger and said fresh water to generate steam which is fed to said preceding drying zone.

24. The machine according to claim 23, further comprising a second heat exchanger for heating fresh air with said hot air taken from said hood, said heated fresh air being furnished as at least one of combustion air and make-up air to said hood allocated to said drying cylinder of said downstream drying zone.

25. The machine according to claim 24, wherein at least one of said first heat exchanger and said second heat exchanger includes a bypass for said hot air taken from said hood.

26. The machine according to claim 25, wherein said bypass for said hot air taken from said hood is flow-regulated.

* * * * *